US005577730A

United States Patent [19]

Vannozzi, Sr.

[11] Patent Number: 5,577,730

[45] Date of Patent: Nov. 26, 1996

[54] FLEXIBLE VINYL CHESS MAT THAT CONVERTS INTO A CARRYING CASE

[76] Inventor: Michael A. Vannozzi, Sr., 3522 Rawhide St., Las Vegas, Nev. 89120

[21] Appl. No.: 499,185

[22] Filed: Jul. 7, 1995

[51] Int. Cl.[6] ..... A63F 3/02

[52] U.S. Cl. ..... 273/260; 273/286; 273/285; 206/315.1; 206/579; 383/4; 383/7

[58] Field of Search ..... 273/286, 285; 206/315.1, 579; 383/4, 7

[56] References Cited

U.S. PATENT DOCUMENTS

| | | | |
|---|---|---|---|
| 3,948,528 | 4/1976 | Goodman, Jr. et al. | 273/286 |
| 4,423,834 | 1/1984 | Rush | 383/4 |
| 4,685,570 | 8/1987 | Medow | 206/579 |
| 4,712,673 | 12/1987 | Moore | 273/286 |

FOREIGN PATENT DOCUMENTS

| | | | |
|---|---|---|---|
| 465570 | 9/1951 | Italy | 273/286 |

OTHER PUBLICATIONS

Game Sampler catalog, vol. One, Second Edition, Oct. 1993–Apr. 1994, pp. 18–19.

*Primary Examiner*—Benjamin H. Layno

*Attorney, Agent, or Firm*—Quirk & Tratos

[57] ABSTRACT

This invention consists of a flexible vinyl chess mat having two handles on opposite sides, both disposed in opposing positions to each other and centered on the perimeter of the square shaped chess mat, so that when the chess mat is folded in half, both handles line up with each other, making a doubled carrying handle. On one side of the chess mat a typical chess board is printed on the rubberized vinyl side. On the reverse side of the chess mat, when turned over, to expose the cloth backing side, a fastening means is positioned around the perimeter of the chess mat, and permanently attached, creating, when folded in half and fastened, an inside pocket area in which chess pieces and accessories may be carried and stored. The chess mat, when unfastened and emptied, and laid flat on a flat surface, is ready for chess play. The same mat can then be converted into a carrying case for convenient transportation and storage of chess pieces and accessories.

13 Claims, 3 Drawing Sheets

FLEXIBLE VINYL CHESS MAT THAT CONVERTS INTO A CARRYING CASE

BACKGROUND

The game of chess has been played for centuries, and the the 64 square layout of the classic chessboard is commonly known and used. Chess is a game that is often played in public places, in tournaments and clubs. Players of the game transport their own chess boards and accessories to the place of play. The chessboard of choice of most chess players in tournament play is the vinyl chess mat. A vinyl chess mat is a square piece of white or off-white vinyl with the typical chess board 64 square configuration printed upon the white or off-white (rubberized) side of the vinyl. The printing can be of any darker color, to create the "black" squares. Most chess players carry their chess mats rolled up and tied with a rubber band, with their accessories placed in a bag of some sort. I observed, at many such tournaments, that chess players need an easier way to transport their portable chess mats and necessary accessories. This invention satisfies that need, allowing chess players to conveniently carry their chess pieces, pencils, recording pads and chess clocks inside the vinyl chess mat, which converts into a carrying case and has handles for easier transportation and is in a compact package. The pliant nature of the vinyl allows the carrying case to accommodate larger, rigid accessories, such as larger chess clocks.

DRAWING FIGURES

Figure 1:
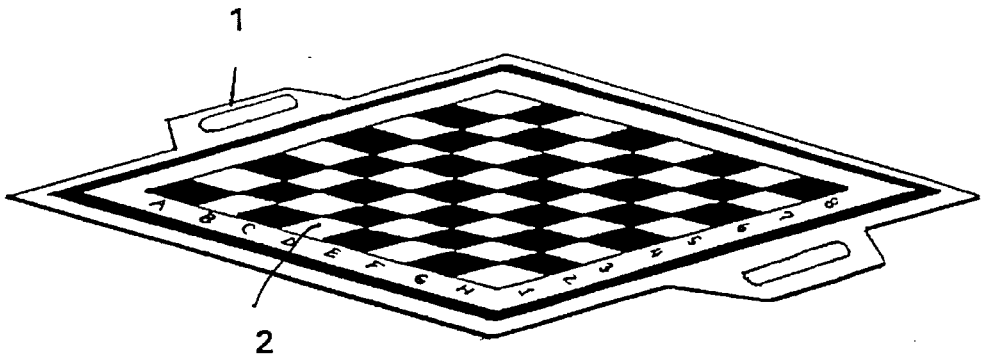

FIG. 1 Chess Mat lying flat for play, side view.

Figure 2:
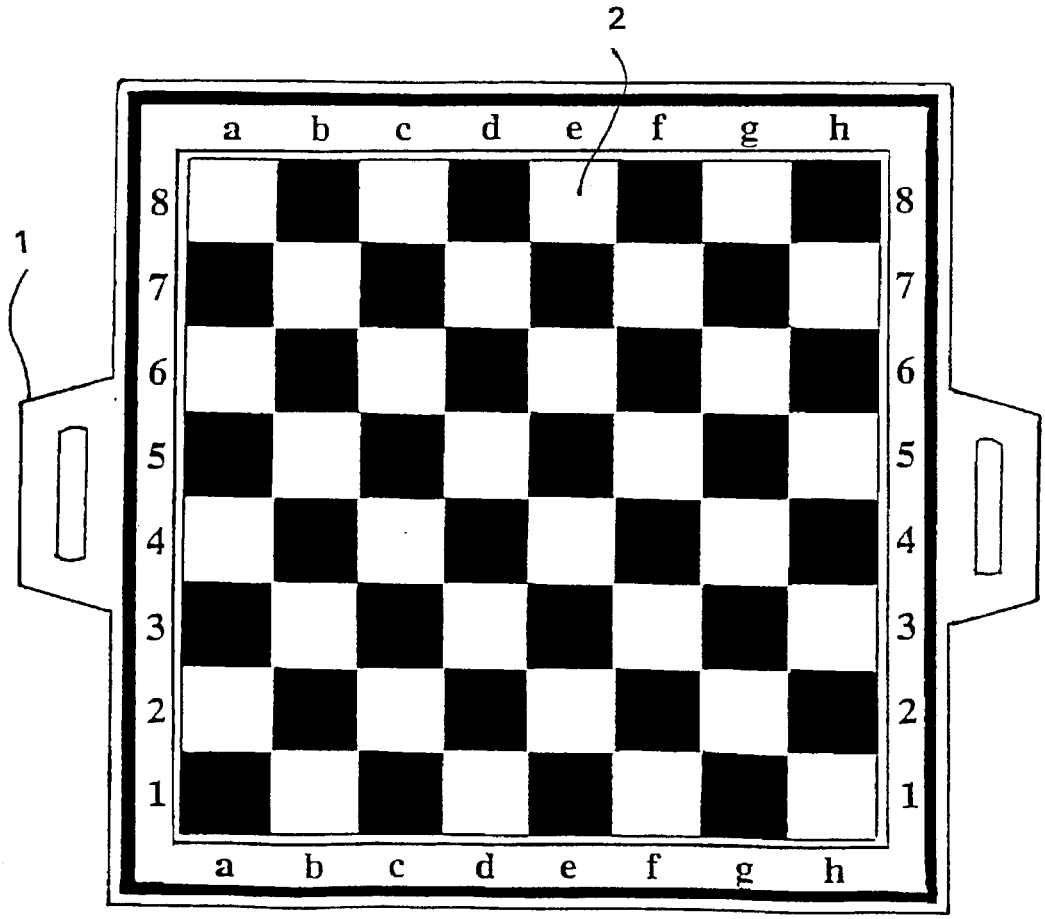

FIG. 2 Chess Mat lying flat for play, overhead view.

Figure 3:
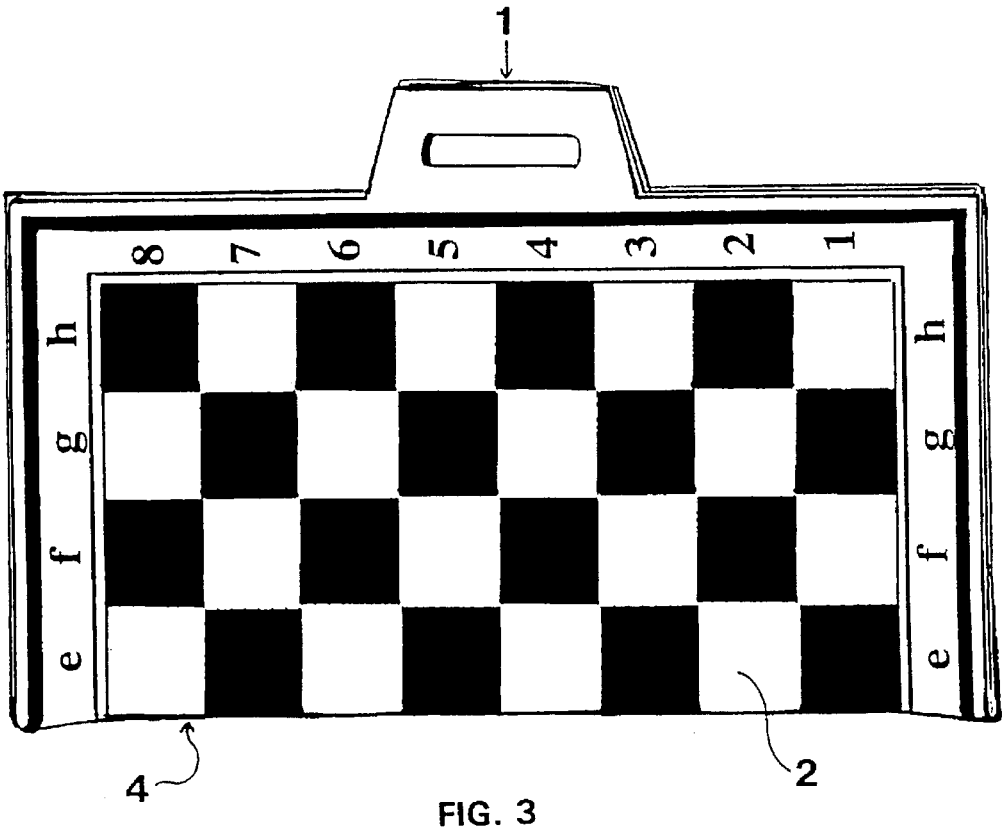

FIG. 3 Chess Mat folded into carrying case—front view.

Figure 4:
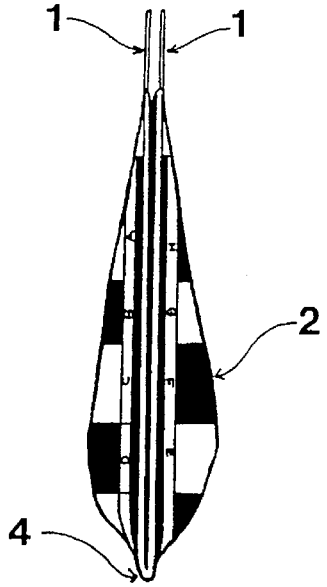

FIG. 4 Chess Mat folded into carrying case—side view.

Figure 5:
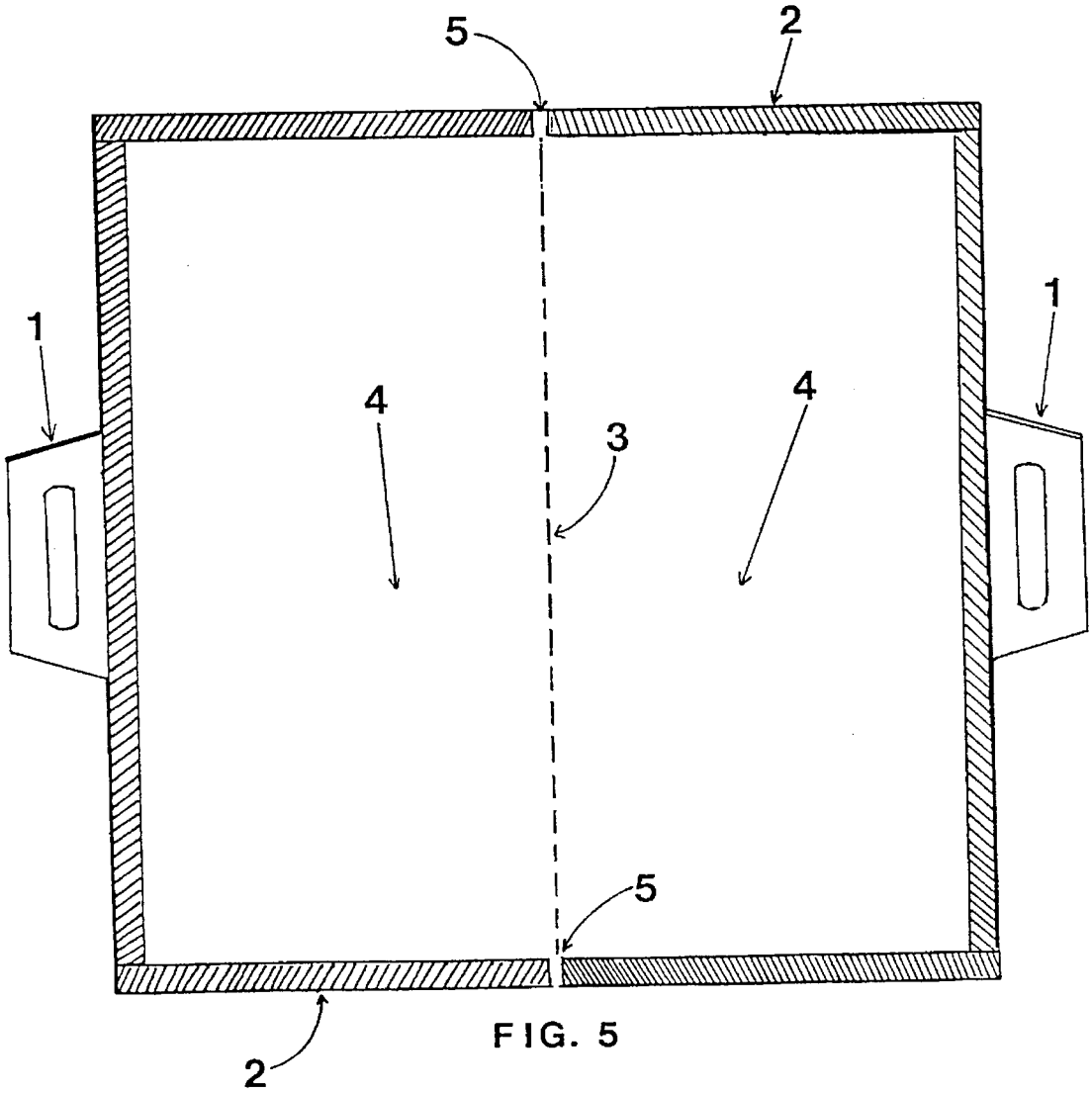

FIG. 5 Chess Mat, cloth backing side, showing fastening means, lying flat, overhead view.

LIST OF NUMERAL DESIGNATIONS

1. handle
2. rubberized vinyl side which has chess board printed upon it
3. fastening means
4. fold line
5. inside pocket area
6. gap between attachment means to allow rounded fold so as to reduce crease
7. cloth side vinyl backing

DESCRIPTION OF THE INVENTION

The invention uses a standard vinyl chess mat, folded it in half, with handles (1) placed on opposite sides of the square in the center, as shown in FIG. 1 through 5. Fastening means, preferably in the form of hook and loop material (3) such as that marketed under the trademark Velcro, are permanently attached to the perimeter of the cloth side vinyl backing (7) shown in FIG. 5 so that the sides of the folded chess mat and the top can be fastened together (FIGS. 3 and 4), creating an inside pocket area (5) for the storage of chess accessories. The fastening means may alternatively comprise snaps, zippers or similar item for joining portions of the mat. When the chess mat is fully opened, the accessories are removed, and the chess mat is placed printed side up. The chess mat then lays completely flat for play, having no creases, folds, bumps, overlapping panels, gaps, or the like, thus providing an uninterrupted, or smooth playing surface, as shown in FIGS. 1 and 2. The handles (1) also lay flat and out of the way on the side of the board where they do not interfere with game play. The chess pieces can then be placed on the mat. After the game is over, the player turns the chess mat over (FIG. 5), folds the chess mat in half (4), aligning the dual handles, and as shown in FIG. 3, affixes the sides with the fastening means, places the pieces and accessories inside the pocket area (5) and fastens the top (FIG. 4). Using the handles, the player can conveniently carry his entire game set in a briefcase style carrying case, as shown in Figures 3 and 4. As illustrated in FIG. 4, when the mat is folded, it forms a "U"-shaped bottom which is devoid of creases, folds or the like.

BACKGROUND—PRIOR ART

Other inventors have designed gameboards that convert to carrying cases, but they use hinges to hold the two sides of the gameboards together (see Wirt et al, 4,502,658, issued 1985, Mar. 5; Petty, 3,613,261, issued 1971, October 1977; and Neal, D204,277, issued 1966, Apr. 5.) Additionally, all these inventions use fastening means such as latches. The fastening means employed in my invention allow the chess board, when opened, to lay flat.

Design patent D204,277, issued to Artie Neal on Apr. 5, 1966, shows a chessboard mounted inside a box that folds into a triangular shaped case. When opened, the sides of the box protrude upward, and may interfere with game play. Neal does not show that game pieces and accessories may fit inside. Larger, bulkier chess clocks may not fit inside the triangular design because it is so narrow at the top. Its rigid box design may also preclude carrying larger and bulkier chess clock designs. Additionally, the game box opens on the bottom, so if the box were to accidentally open while being carried, its contents would fall to the ground and possibly be damaged. Another problem with the rigid case design is the durability of the case itself. Rigid cases, especially the vinyl covered glued wood cases which are the most common, have a tendency to crack and fall apart if impacted, dropped or abused. Also the glues used in the assembly of this type of rigid construction tend to come apart with age, or if exposed to extreme climactic conditions.

The flexibility of the material of the Chess Mat Carrying Case allows the chess mat to expand around larger objects. The top opening precludes any accidental mishaps where the accessories may fall to the ground from the bottom of the carrying case, if the case were to accidentally pop open. Additionally, the design of the Chess Mat Carrying Case lies totally flat, and has no rigid upwardly protruding sides to annoy and hamper the chess player and possibly interfere with the game. The Chess Mat Carrying case is made of a durable, thick pliant vinyl which will not crack, break or fall apart if impacted, dropped or abused, and the fastening means, (Velcro as an example), is sewn to the Vinyl Chess Mat Carrying Case, and will not separate under extreme climactic conditions such as heat, the way glue can.

U.S. Pat. No. 3,613,261, issued to Elijah J. Petty on Oct. 19, 1971, uses a variation of classic chess in its introduction of chips and chip holders. This patent's main focus relates to a device that is a chess playing and learning aid. This patent does, however, show an element of a folding chess board carrying case. Like the Neal patent previously cited, the Petty case is also of a rigid box-like structure. This design also has the limitation of not being able to expand to accommodate the larger bulkier chess clocks. It also suffers the shortcomings of the durability of a rigid case in their tendency to crack and fall apart if dropped, impacted or abused.

U.S. Pat. No. 4,502,658, issued to Buddy C. Wirt and Doris J. Wirt on Mar. 5, 1985, does provide for a container in which to carry and store bingo accessories, but it is not a carrying case in the strictest sense of the term as it does not fully enclose its pieces and accessories inside a closed chamber. It does however have elements of carrying, folding, and of a game board. The design has legs and slants so that the bingo player can see the the game sheet and a clip holds the game sheet in place. This design is not applicable to the game of chess, and is not suitable to the task of carrying chess pieces and accessories.

I claim the following:

1. A game mat convertible into a carrying case comprising:

a substantially planar mat having no creases, fold lines or score lines, said mat made of plyable, durable material, said mat having a front side, a back side, and first and second opposing edges and opposing third and fourth edges, said mat having game indicia located on at least one side thereof, and further including a first handle and a second handle located on opposite first and second edges respectively, said handles arranged so that, when the mat is folded, the first and second edges are placed proximate one another and both handles line up with each other, making a doubled carrying handle for the chess mat, and when the chess mat is unfolded, the handles lay flat to the side of the game board; and interengaging fastening means positioned on said mat along opposing edges thereof, for joining said first and second edges to one another, and for joining a portion of said third, whereby when mat is folded and said fastening means are engaged, the edges and a folded side of said mat forms an enclosed pocket.

2. The game mat of claim 1, wherein said fastening means comprises hook and loop material.

3. The game mat of claim 1, wherein chess game board indicia are located on at least one of said sides of said mat.

4. A game mat movable between a flat playing position and a folded position forming an enclosure for storing gaming paraphernalia comprising:

a flexible gaming mat having no creases, fold lines or score lines, said mat having a first edge, a second edge opposing said first edge, a third edge, and a fourth edge opposing said third edge, said first, second, third, and fourth edges forming a perimeter of said mat, said mat having a first side and a second side;

a first handle connected to said first edge and a second handle connected to said second edge, said handles arranged so that when said mat is folded and said first and second edges are placed proximate one another, said handles are in substantial alignment; and fastening means located about at least a portion of said perimeter of said mat for joining said first and second edges to one another, and for joining a portion of said third edge to itself and a portion of said fourth edge to itself, whereby when said mat is folded as described above and said fastening means are fastened, an enclosure is formed.

5. The mat of claim 4, wherein chess game board indicia are located on at least one side of said mat.

6. The mat of claim 4, wherein said fastening means comprises hook and loop material connected to said mat on one of said sides thereof.

7. The mat of claim 6, wherein chess board indicia are located on the side of said mat opposite said side said hook and loop material is connected to.

8. The mat of claim 4, wherein said mat is constructed of vinyl.

9. A game mat movable between a flat playing position and a folded position forming an enclosure for storing gaming paraphernalia comprising:

a flexible gaming mat having no creases, fold lines or score lines, said mat having a first edge, a second edge opposing said first edge, a third edge, and a fourth edge opposing said third edge, said first, second, third, and fourth edges forming a perimeter of said mat, said mat having a first side and a second side, said sides defining a smooth-surfaced central playing area within said edges;

handle means connected to said first and second edges of said mat respectively for carrying said mat; and inter-engaging fastening means located about at least a portion of said perimeter of said mat for joining said first and second edges to one another, and for joining a portion of said third edge to itself and a portion of said fourth edge to itself, whereby when said mat is folded as described above and said fastening means are fastened, an enclosure is formed.

10. The mat of claim 9, wherein said first side is smooth and includes gaming indicia thereon.

11. The mat of claim 9, wherein said handle means comprises a first handle connected to one of said edges and a second handle connected to an opposing edge.

12. The mat of claim 9, wherein said fastening means comprise hook and loop material.

13. The mat of claim 9, wherein when said interengaging fastening means are fastened, said mat forms a creaseless, foldless, generally "U"-shaped member.

* * * * *